United States Patent [19]

Görike et al.

[11] Patent Number: 5,031,216

[45] Date of Patent: Jul. 9, 1991

[54] DEVICE FOR STEREOPHONIC RECORDING OF SOUND EVENTS

[75] Inventors: Rudolf Görike; Fritz Sippl, both of Vienna; Sandor Szabo, Klosterneuburg-Kierling, all of Austria

[73] Assignee: AKG Akustische u. Kino-Geräte Gesellschaft m.b.H., Vienna, Austria

[21] Appl. No.: 372,155

[22] Filed: Jun. 27, 1989

Related U.S. Application Data

[63] Continuation-in-part of Ser. No. 104,652, Oct. 2, 1987, abandoned.

[30] Foreign Application Priority Data

Oct. 6, 1986 [AT] Austria ..... 2641/86

[51] Int. Cl.[5] ..... H04R 5/027

[52] U.S. Cl. ..... 381/26

[58] Field of Search ..... 381/26

[56] References Cited

U.S. PATENT DOCUMENTS

| | | | |
|---|---|---|---|
| 4,037,064 | 7/1977 | Yasuda | 381/26 |
| 4,308,426 | 12/1981 | Kikuchi | 381/155 |
| 4,410,770 | 10/1983 | Hagey | 381/194 |
| 4,586,194 | 4/1986 | Kohashi et al. | 381/60 |
| 4,757,545 | 7/1988 | Rosander | 381/191 |

FOREIGN PATENT DOCUMENTS

| | | | |
|---|---|---|---|
| 0050100 | 4/1982 | European Pat. Off. | 381/26 |
| 1927401 | 12/1970 | Fed. Rep. of Germany . | |

OTHER PUBLICATIONS

Article-Natürliches Hören mit künstlichem Kopf (Funkschau 6/1983, pp. 41–44).

Article-Kopf—Stereomikrofon für Amateure (Funkschau 1974, Heft 9 pp. 305–307).

*Primary Examiner*—Forester W. Isen

*Attorney, Agent, or Firm*—Toren, McGeady & Associates

[57] ABSTRACT

A device for the stereophonic recording of sound events by means of two microphones arranged with essentially oppositely directed orientation and mounted in replicas of the human head. The microphones are mounted in the replicas of the outer auditory meatus. The replica of the human head is limited to the replicas of the pinnae with the outer auditory meatus. Microphones with unilateral pickup effect are used and are mounted preferably in positions corresponding to the positions of the pinna openings in human heads. The microphones operate in the low-frequency range of up to approximately 1500 Hz as directional microphones and, in the frequency range above approximately 1500 Hz, operate with spectral resolution of the outer ear transmission function. The device according to the present invention provides compatibility of headset reproduction and loudspeaker reproduction.

11 Claims, 4 Drawing Sheets

DEVICE FOR STEREOPHONIC RECORDING OF SOUND EVENTS

This is a continuation-in-part of application Ser. No. 07/104,652, filed Oct. 2, 1987, now abandoned.

BACKGROUND OF THE INVENTION

1. Field of the Invention

The present invention relates to a device for the stereophonic recording of sound events by means of two microphones arranged with essentially oppositely directed orientation and mounted in replicas of the human head. The microphones are mounted in the replicas of the outer auditory meatus.

2. Description of the Prior Art

The known so-called dummy-head transmission method has made it possible to obtain a very good quality of sound transmissions in connection with headset reproductions. However, it has not been possible to make this headset reproduction compatible with loudspeaker reproduction. It has been made possible to come closer to compatibility by efforts to use diffuse sound field equalization instead of free sound field equalization of the dummy-head and of the headset. On the other hand, when used in actual transmissions, the dummy-head represents an optical annoyance and, therefore, cannot be used in all situations.

German Offenlegungsschrift 1,927,401 discloses dummy-heads from which the microphones and ear replicas can be removed. A microphone and an ear replica form together a unit. When both units are removed from the dummy-head, the units constitute individual elements which do not have an allocation relative to each other. Thus, in this state, defined recording conditions do not exist, so that it is not possible in this state to use the microphones as if they were mounted in a dummy-head. Accordingly, this type of use is not described in German Offenlegungsschrift 1,927,401.

The article "Kopf-Stereomikrophon für Amateure" [Head Stereomicrophone for Amateurs], Funkschau 1976, Volume 9, Pages 971–973 (305–307), describes that in the use of microphones with dummy-heads, the quality of reproduction is improved by changing from the use of simple replicas of heads to replicas which include reproductions of the head with hair, beard or the like. In accordance with the present invention, on the other hand, the dummy-head is not used at all.

The article "Natüliches Hören mit künstlichem Kopf" [Natural Hearing with Artificial Head], Funkschau 1984, Volume 6, pages 41–44, describes the problem that recordings using dummy-heads are only brilliant when reproduced in headsets, but are lacking in quality when reproduced by loudspeakers. This article describes a dummy-head microphone whose recordings are also suitable for loudspeaker production. The reason for this is that the microphones are arranged conventionally in such a way that a diffuse sound field equalization is carried out instead of a free sound field equalization. A number of coupling elements are additionally required for the diffuse sound field equalization.

It has been found that a different solution exists for realizing a transmission through loudspeakers of high quality without having to meet the above-mentioned requirements. Thus, a reproduction of suitably high quality for loudspeakers can be obtained if only the pinnae of the dummy-head are used and microphones of the type are used which operate as directional microphones in the low-frequency range of up to about 1500 Hz and, in the frequency range above 1500 Hz, operate with spectral resolution of the outer ear transmission function. Also, this has the advantage that additional acoustic effects can be achieved by modifying the pickup pattern and the position of the pinnae.

It is the object of the present invention to provide a device of the above-mentioned type for the stereophonic recording of sound events in which the use of a complete replica of the human head is avoided and the headset reproduction and loudspeaker reproduction are compatible. In addition, a number of modifications of the sound reception are to be made possible.

SUMMARY OF THE INVENTION

In accordance with the present invention, the replica of the human head is limited to the replicas of the pinnae with the outer auditory meatus. Microphones with unilateral pickup effects are used and are mounted preferably in positions corresponding to the positions of the pinna openings in the human head. The microphones operate in the low-frequency range of up to approximately 1500 Hz as directional microphones and, in the frequency range above approximately 1500 Hz, operate with spectral resolution of the outer ear transmission function.

The known dummy-heads include within the replica of each head pressure pickups or microphones connected to the pinnae which operate predominantly on electrostatic basis and which contain one or more passive filters for the free sound field equalization. However, these measures were not capable of preventing problems with respect to comb filter-type ear resonances. An improved embodiment was obtained with the diffuse sound field equalization by means of a radially arranged auditory meatus and a coupler in front of the microphone capsule.

The question of compatibility of headset reproduction and loudspeaker reproduction is of primary significance. This compatibility cannot be successfully obtained in the method using a dummy-head because the pickup effect of the microphones which are used for biphonic reproduction methods which are presently used for sound recordings and require a cancellation by the pickup pattern up to 25db, reach only 10db in the method using a dummy-head. Thus, as in cases where two omnidirectional microphones with slight pickup effect are used, the recording is not satisfactory due to the spacing and the pressure build-up. This results in sound distortions and other transmission errors, so that reproduction by means of loudspeakers is not possible.

Stereo signals recorded by conventional cardioid microphones, on the other hand, do not have the comb filter structure of the human ear. When these signals reach the ear of the listener through loudspeakers, his ears should be able to recognize through their direction-dependent resonances, the distance and the direction toward the sound event. However, since the sound signals do not come in the direction which coincides with the original sound event, the formation of the correct original signal is no longer possible. Only the intensity effect of the biphonic reproduction method remains.

In the device according to the invention, each pinna made, for example, of silicone rubber, in the natural size of the human ear, has at the connecting point of the human auditory meatus within the passage or the end thereof a microphone having preferably a unilateral pickup effect, e.g., of the electretic type. Such microphones with this kind of pickup effect make it possible to reach the impedance of the eardrum due to the softly supported diaphragm, at approximately 1000 Hz in the capacitor type, or approximately 200 Hz in dynamic transducers. No disturbing incidences occur in the frequency range of above about 1500 Hz in which the pinnae determine the psycho-acoustic effect of the directional and distance hearing due to the ear resonances having comb filter structure.

The sound recording is carried out by the diaphragm of the microphone which has an impedance similar to that of the natural eardrum, so that no reflections occur.

The microphones operate below about 1500 Hz with unilateral pickup effect with the pinnae positioned in accordance with the human head at an angle of about 105° since the size of the pinna acts as a deflecting disk for the pressure gradient.

In the frequency range below 1500 Hz, the time difference as well as the intensity difference are dependent in the human head from the angle of incidence of the sound waves. On the other hand, only intensity is effective in the stereo transmission with two pinna replicas and the directional microphones connected thereto. Contrary to the use of the dummy-head, a variety of effects can be obtained in the transmission technology by the shape of the pickup pattern as well as by rotating or inclining the ears.

The total surface area of the pinna is responsible for the magnitude of the pressure gradient of the directional microphone operating in the low-frequency range. In the frequency range above 1500 Hz, the hollow spaces of the pinna with the characteristic recesses in the pinna are the determining factor due to the formation of the comb filter structure. In the low frequency range up to $\lambda/2$, the pressure gradient is effective which above this frequency range decreases in accordance with a Bessel function. During this decrease, the pinna begins to become effective, so that the directional and distance effects which are decisive for stereophonic hearing are generated already in the double frequency range.

In accordance with an advantageous further development of the invention, the two pinna replicas are mounted next to each other in a sound-permeable housing with the ear openings facing away from each other. Contrary to the dummy-head which frequently constitutes an obstacle due to its size, this development according to the invention makes possible the simple mounting of the pinna replicas in sound-permeable housings within the conventional dimensions of stereo microphones.

The pinna replicas may also advantageously be mounted in a sound-permeable housing one above the other. This arrangement makes possible the use of slender microphones of the capacitor type.

In accordance with another feature of the present invention, the diameters of the auditory meatus and of the directional microphone are of approximately the same magnitude. When microphones are used which have the same diameter as the auditory meatus of the pinna replica, no specific adjustments are required because the diaphragm has approximately the same surface area as the eardrum of the human ear.

In accordance with a further feature of the present invention, the auditory meatus leads into an open chamber having a greater diameter, wherein the diameter of the microphone arranged in this chamber is greater than the diameter at the end of the auditory meatus. This results in the advantage that, in order to meet the requirements of digital technology, the signal-to-noise ratio is increased due to the greater electrical capacitance of the microphone.

In accordance with another feature of the present invention, the open chamber is constructed in conjunction with a damped mass as a series-tuned wave trap and is arranged in front of the diaphragm of the microphone. In order to meet the requirements of the previously used free sound field measuring method in the direction toward the diffuse sound field measurement, an acoustic low-pass filter as a series-tuned wave trap arranged in front of the diaphragm of the microphone is an acoustically advantageous solution.

Also, in accordance with an advantageous feature, the outer auditory meatus is reproduced in the form of a separate tube. For completely reproducing the human outer ear, a reproduction of the auditory meatus has been found advantageous.

In accordance with an advantageous further development of the invention, each pinna replica is mounted in a separate housing which is rotatable and tiltable. The use of separate housings for the pinna replicas results in the advantage that acoustic fine tuning can be improved by tilting or rotating each housing.

In accordance with yet another advantageous feature of the present invention, two cardioid microphones with electric low-pass filters are arranged in addition to the pinna replicas with electric high-pass filters. The alignment of the pair of microphones with high-pass filters is adjustable relative to the pair of microphones with low-pass filters. The acoustic adjustment can be further improved by dividing the transmission range into a microphone with high pass filter and a microphone with low-pass filter, wherein the high-pass filter range operates with pinna replicas and the low-pass range operates with conventional cardioid microphones.

Finally, in accordance with further development of the invention, the microphones with unilateral pickup effect are inserted in the pinna replicas obliquely relative to the axis of the pinna or with an inclined speaking opening, wherein the position of the pinna replicas corresponds to the position of the ears in the human head. This embodiment meets the requirements with respect to recording techniques previously used in stereophonic recordings. Specifically, such an arrangement has the advantage that, in the frequency range of below approximately 1500 Hz, the recording angle of the two microphones of between 90° and 140° C. is selected which is conventional for stereo recordings, while above the aforementioned frequency only the outer ear transmission function is operative.

In accordance with another further development of the invention, the pinna replicas are arranged spaced apart by approximately 18 cm. This arrangement has the particular advantage that the interaural time difference between the two pinna replicas becomes fully effective.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
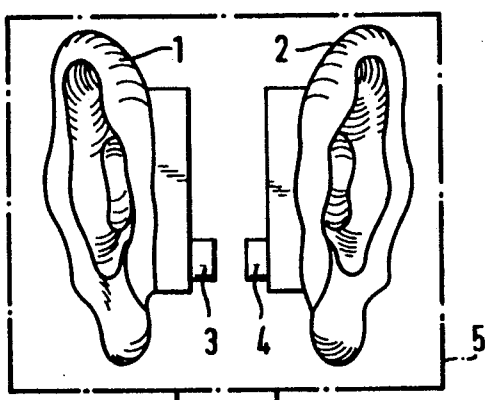
FIGS. 1 to 4 and 10 show pinna replicas mounted in microphone housings.
Figure 2:
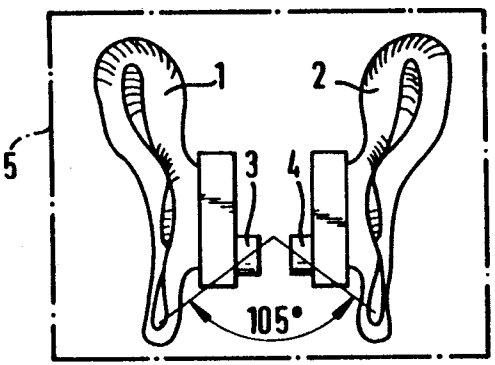

As illustrated in FIG. 1 of the drawing, two pinna replicas 1, 2 with microphones 3, 4 mounted in the opening of the auditory meatus of the human ear are arranged closely next to each other. FIG. 2 is a top view of the arrangement shown in FIG. 1.

Figure 3:
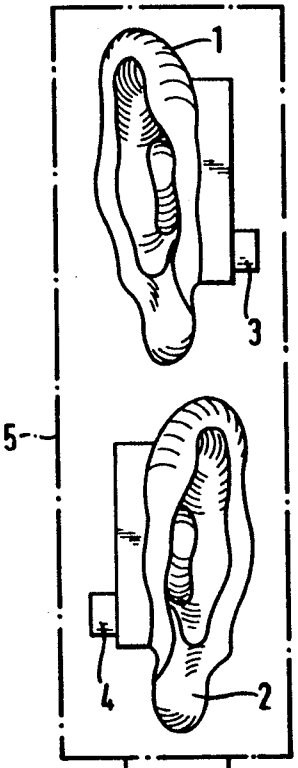

In the embodiment illustrated in FIG. 3, two pinna replicas 1, 2 with microphones 3, 4 are arranged one above the other.

Sound-permeable housings for the pinna replicas are shown in FIGS. 1 to 4 in dash-dotted lines and are denoted by reference numeral 5. For clarity's sake, the drawing does not show the manner in which pinna replicas are mounted within the housings.

Figure 4:
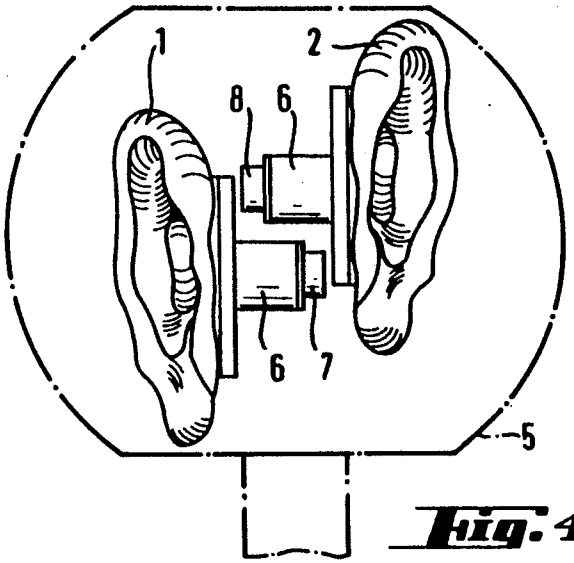

FIG. 4 of the drawing shows two pinna replicas 1, 2 with tubes 6 intended to imitate the human auditory meatus attached to replicas 1, 2. Microphones 7 and 8 are connected to tubes 6.

Figure 5:
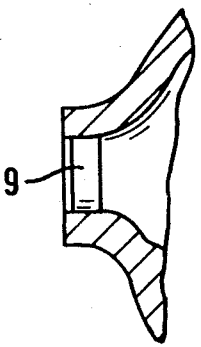
FIGS. 5 and 6 are partial sectional views of pinna replicas.

As illustrated in the sectional view of FIG. 5, a microphone 9 having the same diameter as the auditory meatus is inserted in the replica of the auditory meatus.

Figure 6:
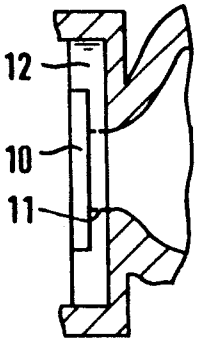

FIG. 6, on the other hand, shows a microphone 10 whose diameter is greater than that of the auditory meatus. An acoustic low-pass filter as series-tuned wave trap, comprising a damped mass 11 and an open chamber 12, makes it possible to lower the frequency response in the range of about 3000 Hz, in order to obtain compatibility between headset and loudspeaker for diffuse sound field equalization.

Figures 7, 8:
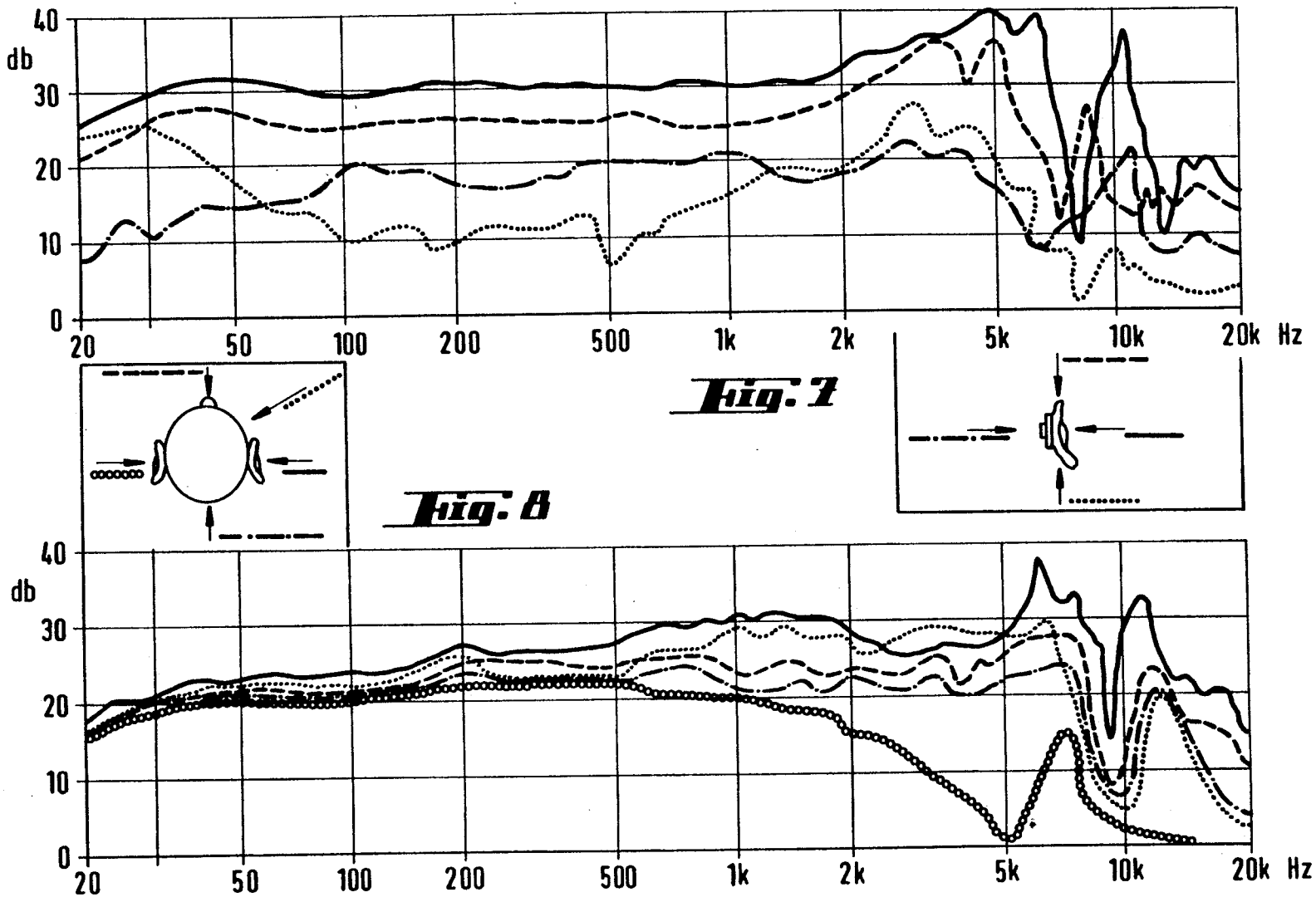
FIGS. 7 and 8 are diagrams illustrating measured frequencies of microphones for different angles of incidence.

FIG. 7 shows the measured frequencies of a sound pickup according to the present invention in a dead space for different angles of incidence at constant sound pressure. FIG. 8 shows the corresponding measurement results for a microphone on a conventional dummy-head for different angles of incidence.

Figure 9:
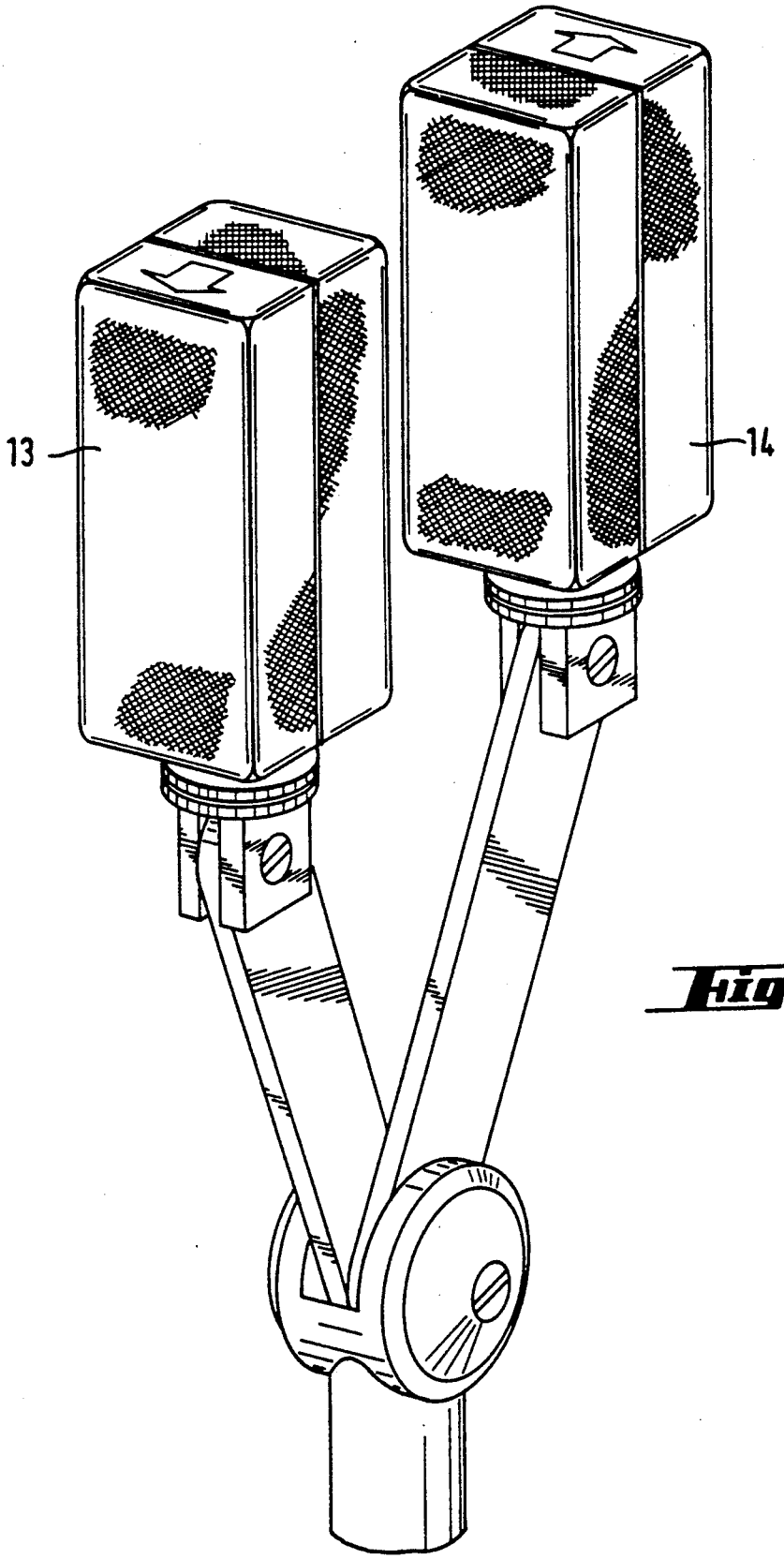
FIG. 9 is a perspective view of a device according to the present invention.

FIG. 9 shows the device according to the present invention with two separate housings 13, 14 in which the pinna replicas are mounted. By rotating and tilting these housings, the recording characteristics with respect to the stereophonic impression of the transmission can be subjectively regulated.

In the diagrams of FIGS. 7 and 8, the device according to the present invention and the microphone using a dummy-head are compared.

As the frequency curves for different directions of incidence of FIG. 7 show, the device according to the invention is capable of providing, from the lowest frequencies to approximately 1500 Hz, a pickup effect which is independent of the frequency and a cancellation of from approximately 20db and thereabove and, in the higher frequency range, the comb filter structure which corresponds to the pinna. On the other hand, FIG. 8 shows that the microphone with dummy-head is characterized in the frequency range below 1500 Hz by a pickup effect of at most 8db. This means that only series-tuned wave trap, diffraction and reflection of the head replica become effective by the pressure pickups used. Accordingly, the compatibility of headset reproduction and loudspeaker reproduction is also impaired. The incompatibility of cardioid stereo microphones next to systems with dummy-heads is due to these differences in the range below 1500 Hz leading to substantial differences in stereophonic sound. FIGS. 7 and 8 show the frequency-dependent peaks and valleys within the high-frequency range which are determined by the direction of sound incidence and are the decisive factor for the direction and distance of the sound source.

Figure 10:
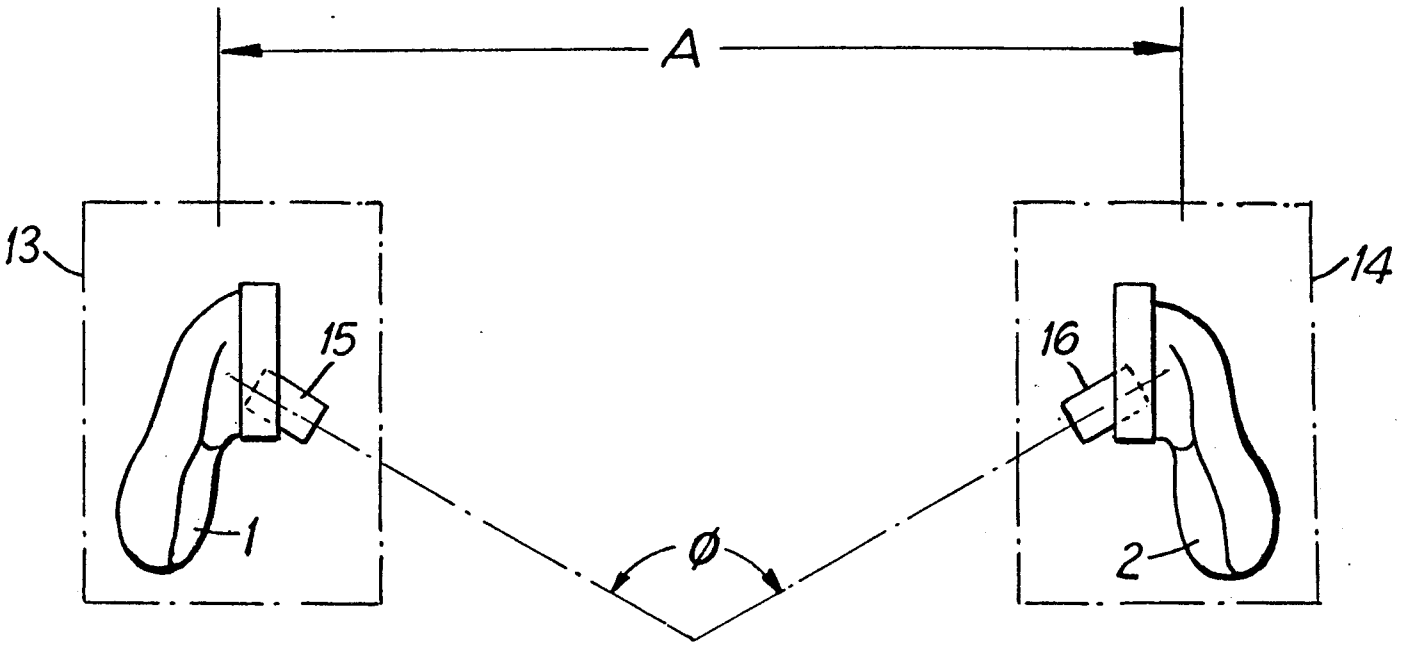

In the embodiment illustrated in FIG. 10, the two microphones 15, 16 for the stereophonic recording are inserted in the respective pinna replicas 1, 2 obliquely relative to the axis of the pinna or with an inclined speaking opening. The position of the pinna replicas 1, 2 remains the same as that in the human head, so that the microphones 15, 16 with pickup effect for stereophonic recording include an angle $\phi$ of about 90° to about 140° C.. Thus, the positioning of the microphones for frequencies below about 1500 Hz which is conventional and proven generally in stereophonic recordings is maintained, while, in the range of high frequencies, the alignment and pickup effect are provided together with the frequency pattern of the pinna replicas 1, 2.

When the pinna replicas 1, 2 mounted in housings 13 and 14 and the microphones 15, 16 with unilateral pickup effect inserted in the pinna replicas 1, 2 are mounted at a distance A from each other, generally about 18 cm, the intensity influence as well as the delay time influence between the two pinna replicas become fully effective. The recording angle $\phi$ of about 90° to 140° C. already mentioned above can also be maintained in this case for the pickup effect of the stereophonic recording below 1500 Hz.

While specific embodiments of the invention (have been shown and described in detail to illustrate the application of the inventive principles, it will be understood that the invention may be embodied otherwise without departing from such principles.

We claim:

1. A device for the stereophonic recording of sound events, comprising pinna replicas of the human head with outer auditory meatus, each meatus having an inner end, a microphone mounted at the end of each auditory meatus, the pinna replicas arranged in such a way that the microphones are oriented essentially in opposite directions, wherein the pinna replicas are mounted so that the positions of the pinna openings relative to each other correspond to those of the human head, the microphones having unilateral pickup effects, the microphones being unidirectional in the low-frequency range of up to approximately 1500 Hz and, and, in the frequency range above approximately 1500 Hz, operating with spectral resolution of the outer ear transmission function.

2. The device according to claim 1, comprising a sound-permeable housing, the pinna replicas being mounted in the housing next to each other with the pinna openings facing away from each other.

3. The device according to claim 1, comprising a sound-permeable housing, the pinna replicas being mounted in the housing one above the other.

4. The device according to claim 1, wherein the inner diameter of the auditory meatus and the diameter of each microphone are essentially equal.

5. The device according to claim 1, wherein each auditory meatus opens at the inner end thereof in an open chamber having a greater diameter than the auditory meatus, the microphone being mounted in the chamber, and wherein the diameter of each microphone is greater than the diameter at the end of the auditory meatus.

6. The device according to claim 5, wherein each microphone includes a diaphragm each open chamber defining in conjunction with a damped mass a series-tuned wave trap and being arranged in front of the diaphragm of the microphone.

7. The device according to claim 1, wherein each other auditory meatus is formed by a tube.

8. The device according to claim 1, comprising separate housings for each pinna replica, the housing being rotatable and tiltable.

9. The device according to claim 1, wherein the pinna replicas include electric high-pass filters, further comprising two cardioid microphones with electric low-pass filters, wherein the alignment of the high-pass filters is adjustable relative to the microphones with low-pass filters.

10. The device according to claim 1, wherein the microphones with unilateral pickup effect are inserted in the pinna replicas obliquely relative to the axis of the pinna or with an inclined speaking opening, wherein the position of the pinna replicas corresponds to the position of the ears in the human head.

11. The device according to claim 10, wherein the pinna replicas are spaced apart approximately 18 cm.

* * * * *